US007699589B2

(12) United States Patent
Terauchi et al.

(10) Patent No.: US 7,699,589 B2
(45) Date of Patent: Apr. 20, 2010

(54) SCROLL TYPE FLUID MACHINE HAVING A CIRCULATION PATH AND INLET PATH FOR GUIDING REFRIGERANT FROM A DISCHARGE CHAMBER TO A DRIVE CASING AND TO A REAR-SIDE OF MOVABLE SCROLL

(75) Inventors: Kiyoshi Terauchi, Isesaki (JP); Masataka Tsunoda, Isesaki (JP); Kazuyuki Shimamura, Isesaki (JP)

(73) Assignee: Sanden Corporation, Isesaki (JP)

( * ) Notice: Subject to any disclaimer, the term of this patent is extended or adjusted under 35 U.S.C. 154(b) by 226 days.

(21) Appl. No.: 11/666,953

(22) PCT Filed: Oct. 27, 2005

(86) PCT No.: PCT/JP2005/019803

§ 371 (c)(1),
(2), (4) Date: May 2, 2007

(87) PCT Pub. No.: WO2006/049081

PCT Pub. Date: May 11, 2006

(65) Prior Publication Data

US 2008/0138228 A1 Jun. 12, 2008

(30) Foreign Application Priority Data

Nov. 4, 2004 (JP) ..... 2004-321023
Feb. 4, 2005 (JP) ..... 2005-029014

(51) Int. Cl.
*F03C 2/00* (2006.01)
*F03C 4/00* (2006.01)
*F04C 18/00* (2006.01)

(52) U.S. Cl. ..... 418/55.5; 418/55.1; 418/55.6; 418/57; 418/270; 417/372; 417/410.5

(58) Field of Classification Search ..... 418/55.1–55.6, 418/57, 83, 86, 270; 417/310, 366, 372, 417/410.1, 902, 410.5
See application file for complete search history.

(56) References Cited

U.S. PATENT DOCUMENTS 4,365,941 A 12/1982 Tojo et al.

(Continued)

FOREIGN PATENT DOCUMENTS

DE 199 25 744 12/2000

(Continued)

OTHER PUBLICATIONS

Chinese Office Action (in English translation) dated Apr. 25, 2008 issued for the corresponding Chinese Patent Application No. 200580037584.9 (8 pgs.).

*Primary Examiner*—Theresa Trieu
(74) *Attorney, Agent, or Firm*—Cohen Pontani Lieberman & Pavane LLP

(57) ABSTRACT

In a scroll-type fluid machine (4), a refrigerant in a discharge chamber (80) is adjusted at prescribed discharge pressure by using a discharge valve (84), discharged from a scroll unit (52), and supplied to a refrigeration circuit (2), and the machine has a circulation path (7) for introducing the refrigerant in the discharge chamber from the refrigeration circuit toward a drive casing (22) while maintaining the refrigerant pressure, and an inlet path (93) formed in a compression casing (24) and leads the refrigerant in the circulation path to the rear side of a movable scroll (54) to make the led refrigerant counteract the refrigerant discharge pressure acting on the front side of the movable scroll.

11 Claims, 5 Drawing Sheets

U.S. PATENT DOCUMENTS

| | | | | |
|---|---|---|---|---|
| 4,522,575 | A | 6/1985 | Tischer et al. | |
| 4,645,429 | A * | 2/1987 | Asami et al. | 418/94 |
| 4,743,181 | A * | 5/1988 | Murayama et al. | 418/55.5 |
| 6,341,496 | B1 | 1/2002 | Kettner et al. | |
| 6,827,563 | B2 | 12/2004 | Hiwata et al. | |
| 2004/0136854 | A1 | 7/2004 | Kimura et al. | |
| 2004/0253133 | A1 | 12/2004 | Gennami et al. | |

FOREIGN PATENT DOCUMENTS

| | | | |
|---|---|---|---|
| EP | 1 365 152 | | 11/2003 |
| EP | 1 433 956 | | 6/2004 |
| EP | 1 464 840 | | 10/2004 |
| JP | 56-165787 | A | 12/1981 |
| JP | 03064686 | | 3/1991 |
| JP | 6-31630 | B2 | 4/1994 |
| JP | 10-266988 | A | 10/1998 |
| JP | 11-132169 | A | 5/1999 |
| JP | 2000-136782 | | 5/2000 |
| JP | 2000-249086 | | 9/2000 |
| JP | 2000-352386 | | 12/2000 |
| JP | 2004-28017 | A | 1/2004 |

* cited by examiner

SCROLL TYPE FLUID MACHINE HAVING A CIRCULATION PATH AND INLET PATH FOR GUIDING REFRIGERANT FROM A DISCHARGE CHAMBER TO A DRIVE CASING AND TO A REAR-SIDE OF MOVABLE SCROLL

RELATED APPLICATIONS

This is a U.S. National Phase Application under 35 USC 371 of International Application PCT/JP2005/019803 filed on Oct. 27, 2005.

TECHNICAL FIELD

The present invention relates to a scroll-type fluid machine suitable for being installed in a refrigeration circuit of a vehicle air-conditioning system.

BACKGROUND ART

A scroll-type fluid machine of this kind, for example, a scroll-type compressor, is provided with a scroll unit for carrying out a series of processes including the suction, compression, and discharge of a refrigerant. Specifically, the unit comprises fixed and movable scrolls that are engaged with each other. The movable scroll makes a rotating movement around the fixed scroll. Therefore, the capacity of a space formed by each of the scrolls is reduced, and the above-mentioned processes are carried out.

In the compression process, a high-pressure space is produced in the scroll unit due to the discharge pressure of the refrigerant. This pressure acts as thrust load from the front side of the movable scroll toward the rear side thereof. This load moves the movable scroll in the direction of moving away from the fixed scroll. The rear side of the movable scroll is supported on a surface oriented to the fixed scroll in order to perform the above-mentioned processes without fail. In other words, a supporting reaction force counteracting the thrust load acts on the rear side of the movable scroll so as to move the movable scroll in the direction of approaching the fixed scroll. As a result, the front side of the movable scroll abrades away due to friction against the fixed scroll, which degrades the performance of the scroll unit.

Therefore, there has been disclosed a technology of reducing the thrust load by escaping the refrigerant acting on the front side of the movable scroll to the rear side through the inside of the movable scroll (se Unexamined Japanese Patent Publication Nos. 2000-136782, 2000-249086, and 2000-352386).

Since the above-mentioned processes are carried out in the scroll unit, the refrigerant pressure acting on the front side of the movable scroll constantly fluctuates until reaching the discharge pressure.

To be concrete, as disclosed in the conventional technology, when the refrigerant in the process of being compressed is escaped to the rear side of the movable scroll through its inside, the pressure acting on the rear side also fluctuates. Moreover, the refrigerant acting on the front side of the movable scroll is not always immediately delivered to the rear side of the movable scroll. This arouses concern that the thrust load cannot be effectively offset. That is, the above-described technologies have not yet solved the issue of reducing the thrust load.

In recent years, a refrigeration circuit using a refrigerant having a small global warming potential (GWP) value has been developed in consideration to global environment. An example of this kind of refrigerant is natural $CO_2$ (carbon dioxide) gas. As this refrigerant has high working pressure, it is especially requested in this case to reduce the thrust load.

In order to use a $CO_2$ refrigerant having high working pressure, it is preferable that the scroll unit have both simplicity and rigidity. It should be noted that, for example, the structure in which a communication hole is formed in the movable scroll, in which there is provided a check valve for preventing a counter flow from the rear side of the movable scroll to the front side thereof, in which an elastic member is provided to the rear side of the movable scroll, or the like, potentially becomes a hindrance to the above-mentioned processes performed by the scroll unit. Especially in case that the communication hole is formed in the movable scroll, it should be noted that compression efficiency is lowered when the refrigerant acting on the front side of the movable scroll moves to the rear side.

DISCLOSURE OF THE INVENTION

The present invention has been made in light of the above-stated issues. It is an object of the invention to provide a scroll-type fluid machine including a scroll unit with simplicity and rigidity and being capable of reducing thrust load steadily.

The above object is accomplished by the scroll-type fluid machine of the invention. The scroll-type fluid machine has a housing including a drive casing and a compression casing air-tightly fitted to the drive casing, a rotary shaft rotatably supported in the drive casing through a bearing, a scroll unit accommodated in the compression casing, the scroll unit having a movable scroll for carrying out a series of processes including suction, compression, and discharge of a refrigerant in cooperation with a fixed scroll by being driven by the rotary shaft to make a revolution of the movable scroll, a discharge chamber defined in the compression casing, for causing the refrigerant adjusted to prescribed discharge pressure by a discharge valve to feed from the scroll unit to a refrigerant circuit, a circulation path for introducing the refrigerant in the discharge chamber from the refrigerant circuit into the drive casing while maintaining the pressure of the refrigerant, and an inlet formed in the compression casing, for leading the refrigerant in the circulation path to a rear side of the movable scroll to make the refrigerant counteract the refrigerant discharge pressure acting on a front side of the movable scroll.

According to the scroll-type fluid machine, the refrigerant discharged from the discharge chamber is introduced into the drive casing through the circulation path while maintaining high pressure without undergoing processes of expansion and evaporation. The refrigerant from the circulation path is led through the inlet path to the rear side of the movable scroll. To be specific, the discharge pressure of the refrigerant acts on the front side of the movable scroll, whereas pressure that is virtually equal to the refrigerant pressure in the discharge chamber is received as load on the rear side of the movable scroll. Since the refrigerant discharged from the discharge chamber is adjusted to the prescribed discharge pressure by the discharge valve, a fluctuation in the refrigerant pressure acting on the rear side of the movable scroll becomes extremely small. Consequently, thrust load applied to the movable scroll is reliably offset, and abrasion of the movable scroll is reduced.

Furthermore, the pressure on the rear side of the movable scroll is made to counteract the pressure on the front side without adding a change to the movable scroll, so that the scroll unit has both simplicity and rigidity.

Preferably, the scroll unit includes a machine chamber formed in the drive casing, the machine chamber having a motor for driving the rotary shaft when the motor is supplied with electricity, and pressure control means for controlling the pressure of the refrigerant introduced from the circulation path toward the machine chamber and is received on the rear side of the movable scroll in order to adjust balance with the refrigerant discharge pressure acting on the front side of the movable scroll. Since the pressure control means controls the pressure applied to the rear side of the movable scroll as mentioned above, balance is attained between the pressure on the front side and the pressure on the rear side. Therefore, the thrust load with respect to the movable scroll is further reliably offset, and a stable compression process is carried out in the scroll unit, which increases reliability of the scroll unit.

The drive casing has a refrigerant inlet hole through which the refrigerant in the circulation path is introduced toward the machine chamber. The pressure control means is arranged either in the circulation path or in the refrigerant inlet hole. If the pressure control means is arranged in the circulation path located upstream of the refrigerant inlet hole, the pressure control means is applicable to a conventional fluid machine. To the contrary, when the pressure control means is arranged in the refrigerant inlet hole, the pressure control means can be applied if the fluid machine is exchanged with respect to the present refrigeration circuit.

Moreover, the inlet hole may receive the refrigerant from a gas cooler inserted in the refrigeration circuit to be introduced into the machine chamber. In this case, the refrigerant that has been cooled by the gas cooler is introduced into the machine chamber, so that the motor and the like in the machine chamber are protected from heat damage.

There is also provided a second circulation path for leading out the refrigerant in the machine chamber from the machine chamber toward the refrigeration circuit. It is preferable that the refrigerant in the machine chamber be led through the circulation path to a low pressure-side circuit of the refrigeration circuit, and be subsequently introduced to the scroll unit through a suction port formed in the compression casing. More specifically, the refrigerant that has passed through the low pressure-side circuit of the refrigeration circuit, for example, an expansion valve and an evaporator, is not introduced into the machine chamber and is directly introduced into the scroll unit as a suction refrigerant. This makes it possible to avoid the disadvantage that the suction refrigerant absorbs the heat of the motor and is increased in temperature as in the case where the refrigerant that has passed through the expansion valve and the evaporator is introduced into the scroll unit via the machine chamber. This contributes to an improvement in refrigeration performance.

The scroll-type fluid machine may further include a second pressure control means for controlling the pressure of the refrigerant led out of the machine chamber toward the second circulation path in order to maintain the refrigerant pressure in the machine chamber at the prescribed pressure. In this case, the second pressure control means maintains the pressure in the machine chamber, into which the refrigerant flowing toward the rear side of the movable scroll is introduced, at the prescribed pressure. Therefore, the load applied to the rear side of the movable scroll is more stabilized.

The drive casing has a refrigerant outlet hole through which the refrigerant in the machine chamber is led out and directed toward the second circulation path. The second pressure control means is arranged either in the refrigerant outlet hole or in the second circulation path. If the second pressure control means is set in the refrigerant outlet hole, the second control means is applicable if the fluid machine is exchanged with respect to the present refrigeration circuit. If the second pressure control means is inserted in the second circulation path located downstream of the refrigerant outlet hole, the second pressure control means is applicable to a conventional fluid machine.

When the refrigerant in the machine chamber is led out through the refrigerant outlet hole and directed toward an internal heat exchanger inserted in the refrigeration circuit, the refrigerant in the machine chamber can be used for heat exchange in the internal heat exchanger. This contributes to the improvement of refrigeration performance.

When the refrigerant outlet hole is formed to lead the refrigerant in the machine chamber toward the evaporator inserted in the refrigeration circuit, the refrigerant in the machine chamber is supplied to the evaporator. This expands a range that can be controlled by the second pressure control means, thereby increasing advantages in respect of control.

The refrigerant contains lubricating oil. The lubricating oil is separated from the refrigerant in the discharge chamber and may be introduced to the bearing through a communication path formed in the compression casing. In this manner, as the high-pressure refrigerant that has been discharged from the discharge chamber through the refrigeration circuit is introduced into the drive casing. As a result, pressure difference between the drive casing and the discharge chamber becomes small, and the lubricating oil reserved in the discharge chamber can be easily introduced toward the bearing. That is to say, it is not required to take measures for reducing distribution sectional area of the communication path of the lubricating oil to a great degree. The measures are required when the pressure difference between the drive casing and the discharge chamber grows considerably large as in the case where the refrigerant that has passed through the expansion valve and the evaporator is introduced into the scroll unit via the drive casing. Moreover, the flow of the lubricating oil is prevented from being blocked in the communication path.

It is preferable that the refrigerant be a $CO_2$ refrigerant. This is because sufficient durability of the scroll-type fluid machine is secured even if a $CO_2$ refrigerant having high working pressure is used in the refrigeration circuit. Moreover, when a natural $CO_2$ refrigerant is used, this greatly contributes to reduction of environmental load.

BEST MODE OF CARRYING OUT THE INVENTION

Embodiments of the present invention will be described below with reference to drawings.

Figure 1:
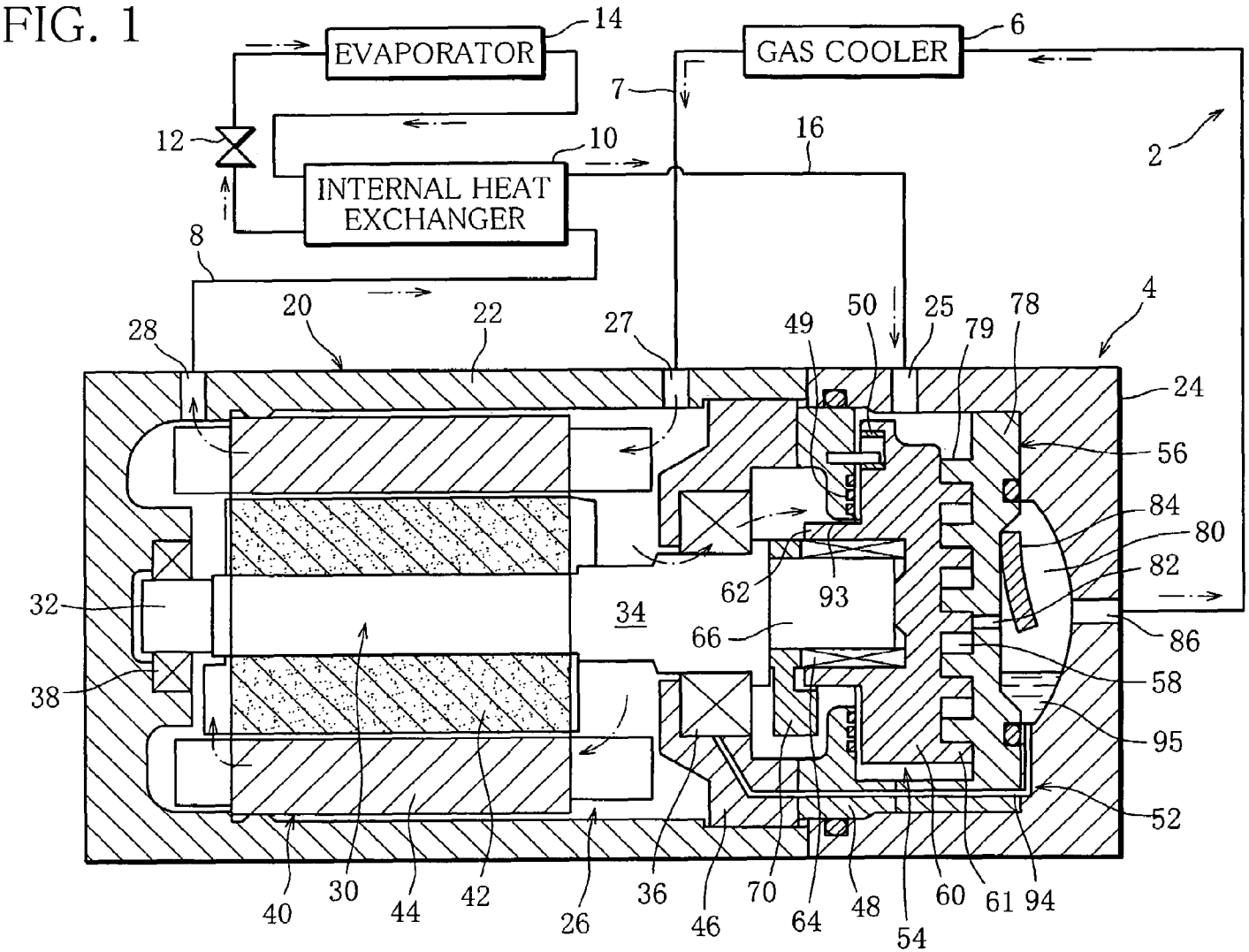
FIG. 1 is a longitudinal sectional view showing a scroll-type compressor according to a first embodiment of the present invention.

FIG. 1 shows a scroll-type fluid machine according to a first embodiment.

The fluid machine is a scroll-type compressor 4 provided with a housing 20. The compressor 4 is installed in a refrigeration circuit 2 of a vehicle air-conditioning system. In the circuit 2, to be specific, the compressor 4, a gas cooler 6, a double-pipe internal heat exchanger 10, an expansion valve 12 and an evaporator 14 are interposed in order. The compressor 4 intakes a $CO_2$ refrigerant (hereinafter, referred to as refrigerant) that is a natural refrigerant from a circulation path 16 located at an outlet side of the internal heat exchanger 10, and compresses and discharges the refrigerant toward an inlet side of the gas cooler 6.

The housing 20 has a drive casing 22 and a compression casing 24. Each of the casings 22 and 24 has a cup-like shape that is open at one end thereof, and opening ends of casings 22 and 24 are air-tightly connected to each other.

An annular supporting block 46 is disposed in the opening end portion of the drive casing 22. The inside of the casing 22, more specifically, space between the block 46 and a bottom portion of the casing 22 is defined as a motor chamber (machine chamber) 26. Disposed in the motor chamber 26 is a stepped rotary shaft 30. The rotary shaft 30 includes a small-diameter shaft portion 32 and a large-diameter shaft portion 34. The small-diameter shaft portion 32 is rotatably supported by the bottom portion of the casing 22 through a needle bearing 38. The large-diameter shaft portion 34 is rotatably supported by the block 46 through a ball bearing 36.

The rotary shaft 30 is driven by turning on the electricity to an electric motor (motor) 40. Concretely, the brushless electric motor 40 is accommodated in the motor chamber 26. A rotor 42 is mounted on an outer circumference of the rotary shaft 30, and a stator 44 is arranged in an outer circumference of the rotor 42 with prescribed gap secured therebetween. Once an electrical current is supplied to the stator 44, the rotor 42 rotates integrally with the rotary shaft 30.

An annular supporting block 48 is disposed in the opening end portion of the compression casing 24. A rear side of the block 48 is in contact with a front side of the block 46. A scroll unit 52 is accommodated in the casing 24, more specifically, in a space defined by the block 48 and a bottom portion of the casing 24. The unit 52 is provided with a movable scroll 54 and a fixed scroll 56.

The scrolls 54 and 56 have respective spiral laps 61 and 79 that are engaged with each other. The laps 61 and 79 form compression chambers 58 in cooperation with each other by using a seal or the like, not shown. When the movable scroll 54 revolves, the compression chambers 58 move from an outer circumference side as viewed in a diameter direction of the laps 61 and 79 toward the center of the laps 61 and 79. In so doing, the compression chambers 58 are reduced in capacity.

In order to achieve the rotating movement of the movable scroll 54, an end plate 60 of the movable scroll 54 has a boss 62 protruding toward the casing 22. The boss 62 is rotatably supported by an eccentric bushing 66 through a needle bearing 64. The bushing 66 is supported on a crank pin, not shown, and the crank pin eccentrically projects from the large-diameter shaft portion 34. Accordingly, when the rotary shaft 30 rotates, the scroll 54 makes its revolution trough the bushing 66. In addition, the bushing 66 is attached with a counter weight 70. The counter weight 70 serves as a balance weight with respect to the rotating movement of the scroll 54.

The fixed scroll 56 is fixed to the bottom portion of the compression casing 24. An end plate 78 of the fixed scroll 56 partitions the casing 24 into the side of the compression chambers 58 and the side of a discharge chamber 80. In a substantially central portion of the end plate 78, there is formed a discharge hole 82 for leading to the compression chamber 58. The hole 82 is opened and closed by a reed valve as a discharge valve and a valve retainer 84. The discharge valve 84 is fixed to the discharge chamber 80 side of the end plate 78, and determines the discharge pressure of the refrigerant discharged from the scroll unit 52 to a prescribed value.

Formed in a circumferential wall of the compression casing 24 is a suction port 25 for communicating with the compression chambers 58. The suction port 25 is connected to the circulation path 16. A discharge port 86 communicated with the discharge chamber 80 is formed in the bottom portion of the casing 24. The discharge chamber 80 is, therefore, connected to the gas cooler 6 through the discharge port 86.

Figure 2:
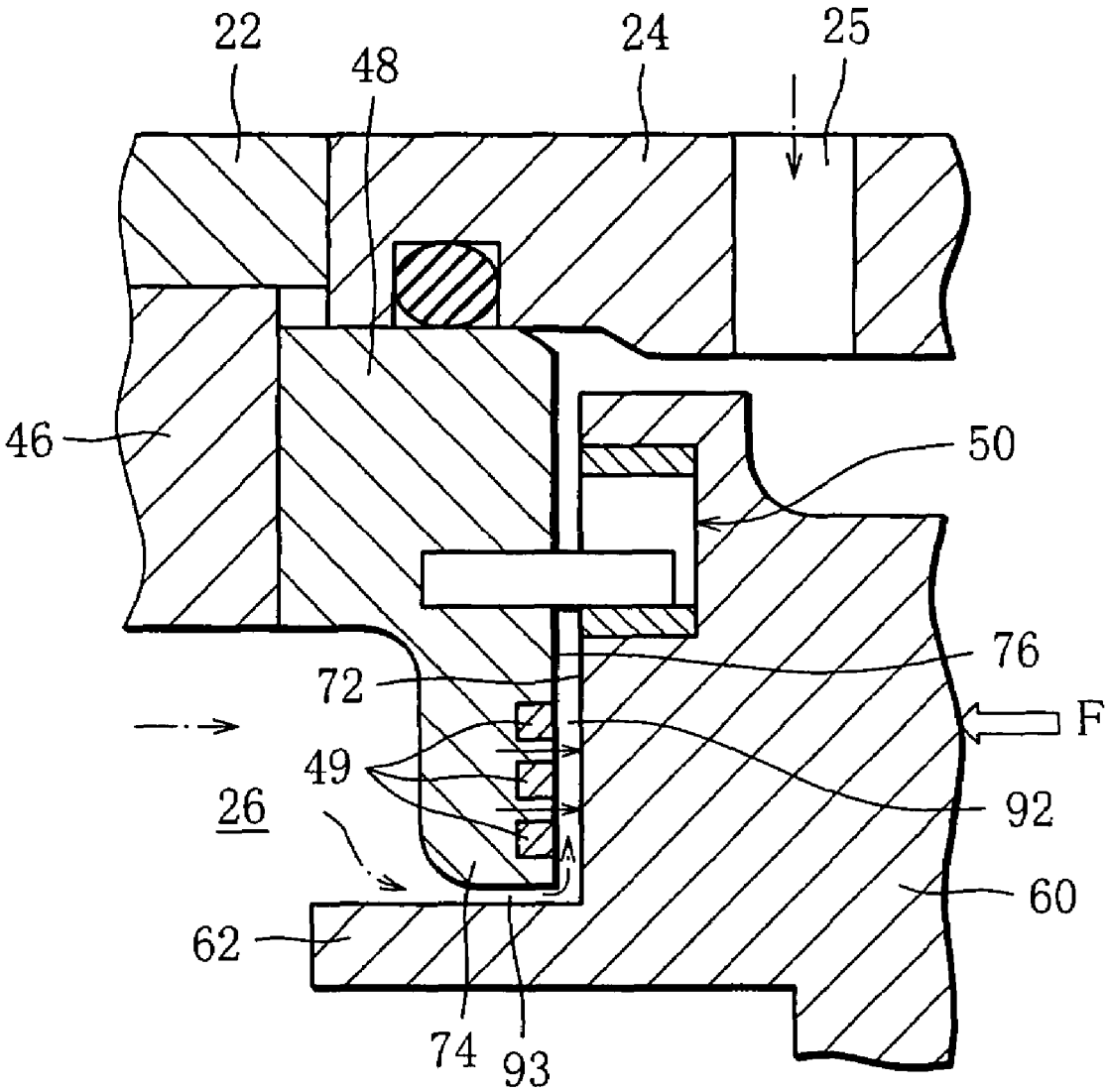
FIG. 2 is an enlarged sectional view showing a main part of FIG. 1.

Not only the refrigerant in the motor chamber 26 but also the refrigerant sucked from the circulation path 16 flows toward a rear side 72 of the movable scroll 54. To be more concrete, as shown in FIG. 2, the block 48 is formed thickly at its portion in contact with the block 46, and has a projection 74 extending inwardly from the thick portion. A front side 76 of the projection 74 faces the rear side 72 of the scroll 54. Three seal rings 49 are arranged on the front side 76 at regular intervals.

Secured between the rear side 72 of the movable scroll 54 and the front side 76 of the block 48 is a buffer gap 92. The gap 92 communicates with the suction port 25, and the refrigerant sucked from the circulation path 16 can flow into the gap 92. A gap (lead-in path) 93 for introducing the refrigerant is also secured between the outer circumference of the boss 62 and an inner circumference of the projection 74 of the block 48. The gap 92 and the motor chamber 26 communicate with each other through the gap 93. That is, the refrigerant in the motor chamber 26 can flow through the gap 93 into the buffer gap 92.

Referring to FIG. 1 again, reference numeral 95 represents lubricating oil that is separated from the refrigerant in the discharge chamber 80. According to the present embodiment, the lubricating oil 95 is introduced to the bearing 36 through a communication path 94 disposed in the compression casing 24. Specifically, the communication path 94 is formed by piercing the casing 24, the end plate 78 of the scroll 56, the block 48 and the block 46.

In the vicinity of the opening end of the circumferential wall of the drive casing 22 according to the present embodiment, there is formed a refrigerant inlet hole 27 for communicating a circulation path 7 connected to an outlet side of the gas cooler 6 with the motor chamber 26. The refrigerant from the gas cooler 6 is introduced through the inlet hole 27 toward the motor chamber 26. According to the present embodiment, in the vicinity of the bottom portion of the circumferential wall of the casing 22, there is formed a refrigerant outlet hole 28 for communicating the motor chamber 26 with the circulation path (second circulation path) 8 extending toward the internal heat exchanger 10.

As described above, in the compressor 4, when the electric motor 40 is supplied with the electricity and then the rotary shaft 30 is rotated, the movable scroll 54 makes the revolution around a shaft center of the fixed scroll 56. In this state, the rotation of the scroll 54 on its axis is prevented by action of a plurality of rotation inhibition mechanisms 50. As a result, the scroll 54 makes the revolution around the scroll 56 while maintaining a fixed revolution posture. The revolution of the scroll 54 causes the refrigerant to be sucked into the compression chamber 58 through the suction port 25 and compresses the sucked refrigerant. The compressed refrigerant makes the discharge valve 84 open when the refrigerant pressure exceeds closing pressure of the discharge valve, and is discharged into the discharge chamber 80 through the opened discharge valve.

The refrigerant in a state of being a high-temperature and high-pressure gas, which has been discharged into the discharge chamber 80, is delivered from the discharge port 86 to the gas cooler 6 and cooled therein. The refrigerant is then introduced into the motor chamber 26 through the circulation path 7 and the inlet hole 27. Part of the refrigerant that has been introduced into the motor chamber 26 reaches the rear side 72 of the scroll 54 through the gaps 93 and 92. At the same time, the rest of the refrigerant cools the stator 44 of the electric motor 40 and flows toward the outlet hole 28. Thereafter, the refrigerant in the state of being a high-pressure and medium-temperature gas is supplied to the internal heat exchanger 10. The refrigerant in the internal heat exchanger 10 is supplied to the expansion valve 12 after being used for heat exchange for a refrigerant from the evaporator 14. The refrigerant supplied to expansion valve 12 is expanded by passing through a throttle hole of the valve 12, and is ejected into the evaporator 14. The air surrounding the evaporator 14 is then cooled by vaporization heat of the refrigerant. In the next place, cold air is sent into a vehicle compartment, and the cooling of the compartment is carried out. The refrigerant in the evaporator 14 returns to the suction port 25 of the compressor 4 through the circulation path 16 and is subsequently compressed again by the compressor 4, thereby circulating in the above-described manner.

As explained above, according to the compressor 4 of the first embodiment, the refrigerant discharged from the discharge chamber 80 is introduced through the circulation path 7 into the motor chamber 26 while maintaining high pressure without undergoing the processes in the expansion valve 12 and the evaporator 14. The refrigerant from the circulation path 7 is led through the gap 93 into the gap 92 located at the rear side 72 of the movable scroll 54. In other words, the discharge pressure of the refrigerant acts on the front side of the movable scroll 54, whereas the pressure that is virtually equal to the refrigerant pressure in the discharge chamber 80 acts on the rear side 72 of the movable scroll 54 as load (shown by solid arrows in FIG. 2). Since the pressure of the refrigerant discharged from the discharge chamber 80 is determined at the prescribed value by the discharge valve 84, the fluctuation of the refrigerant pressure acting on the rear side 72 of the movable scroll 54 is extremely minor. As a result, thrust load F (shown by a white arrow in FIG. 2) with respect to the movable scroll 54 is surely offset, thereby reducing abrasion of the movable scroll 54.

Since the pressure on the rear side 72 is made to oppose the pressure on the front side without adding a change to the movable scroll 54, the scroll unit 52 has both simplicity and rigidity at the same time.

As the refrigerant cooled by the gas cooler 6 is introduced 6 into the motor chamber 26, the electric motor 40 and the like are protected from heat damage.

Furthermore, the refrigerant that has passed through the expansion valve 12 and the evaporator 14 is not introduced into the motor 26 and is directly introduced into the scroll unit 52 as the intake refrigerant. In other words, it is possible to avoid the disadvantage that the intake refrigerant absorbs the heat of the electric motor to be increased in temperature as in the case where the low-temperature refrigerant that has passed through the expansion valve and the evaporator is introduced through the motor chamber into the scroll unit. This contributes to the improvement of refrigeration performance.

The high-pressure refrigerant that has led from the discharge chamber 80 through the circulation path 7 is introduced into the motor chamber 26, and pressure difference between the motor chamber 26 and the discharge chamber 80 becomes small. The lubricating oil 95 reserved in the discharge chamber 80 can be easily led through the communication path 94 toward the bearing 36. In short, it is not required to provide measures for reducing the sectional area of the communication path for the lubricating oil to a great degree. The measures are required when the pressure difference between the motor chamber and the discharge chamber grows considerably large as in the case where the low-pressure refrigerant that has passed through the expansion valve and the evaporator is introduced into the scroll unit via the motor chamber. Further, the measure may tend to block the flow of the lubricating oil in the communication path.

Even if the $CO_2$ refrigerant having high working pressure is used in the refrigeration circuit 2, the sufficient durability of the compressor 4 is secured. When the natural $CO_2$ refrigerant is used, this greatly contributes to the reduction of environmental load.

The invention is not limited to the first embodiment, and may be modified in various ways. A compressor according to a second embodiment will be described below with reference to FIG. 3. In the description of the second embodiment, identical members and portions to those of the first embodiment are provided with identical numeral references, and the description thereof will be omitted.

Figure 3:
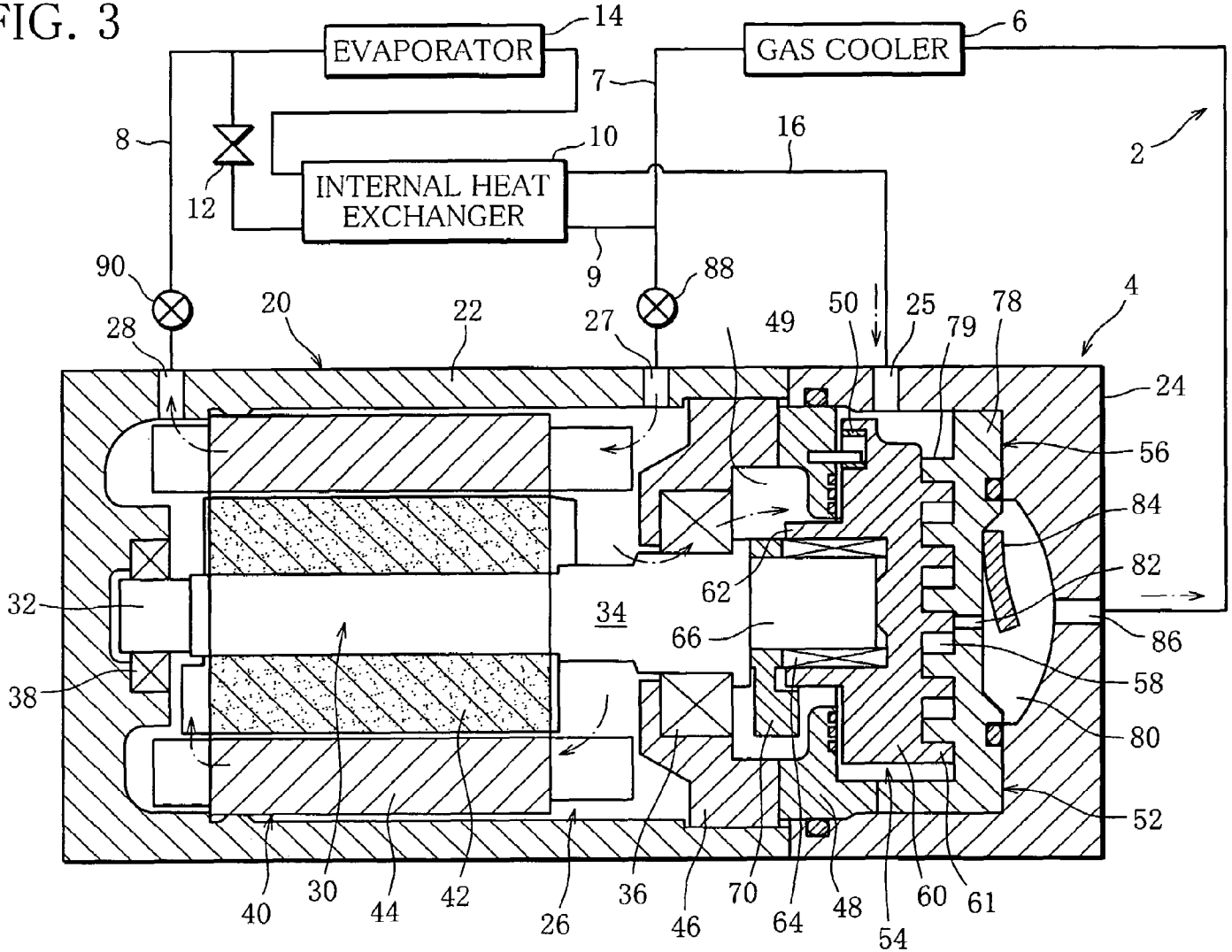
FIG. 3 is a longitudinal sectional view showing a scroll-type compressor according to a second embodiment.

A circulation path 9 is connected the circulation path 7 and extends to the internal heat exchanger 10, as shown in FIG. 3. An inlet control valve (pressure control means) 88 is inserted in the circulation path 7 and located between a connect point for the circulation path 9 and the inlet hole 27. The control valve 88 controls the pressure in a motor chamber 26, and functions to equalize the refrigerant pressure received on the rear side of the movable scroll 54 with the refrigerant discharge pressure acting on the front side of a movable scroll 54.

The circulation path 8 of the second embodiment extends from a low pressure-side circuit between the expansion valve 12 and the evaporator 14. The circulation path 8 leads the refrigerant in the motor chamber 26 to the upstream side of the evaporator 14 through the outlet hole 28. An outlet control valve (second pressure control means) 90 is inserted in the circulation path 8 so as to be located between the outlet hole 28 and an upstream-side connect point for the evaporator 14 and the expansion valve 12. The control valve 90 also controls the pressure in the motor chamber 26 and maintains the refrigerant pressure in the motor chamber 26 at a prescribed pressure.

The control valves 88 and 90 may be disposed not only in the circulation paths 7 and 8 as described above but also in the inlet hole 27 and the outlet hole 28 themselves.

In the compressor 4 of the present embodiment, on the condition that the control valve 88 is open based upon detected pressure $P_M$ of the refrigerant of a high-pressure and middle-temperature gas in the motor chamber 26, the refrigerant that has been cooled in the gas cooler 6 is introduced into the motor chamber 26.

Figure 4:
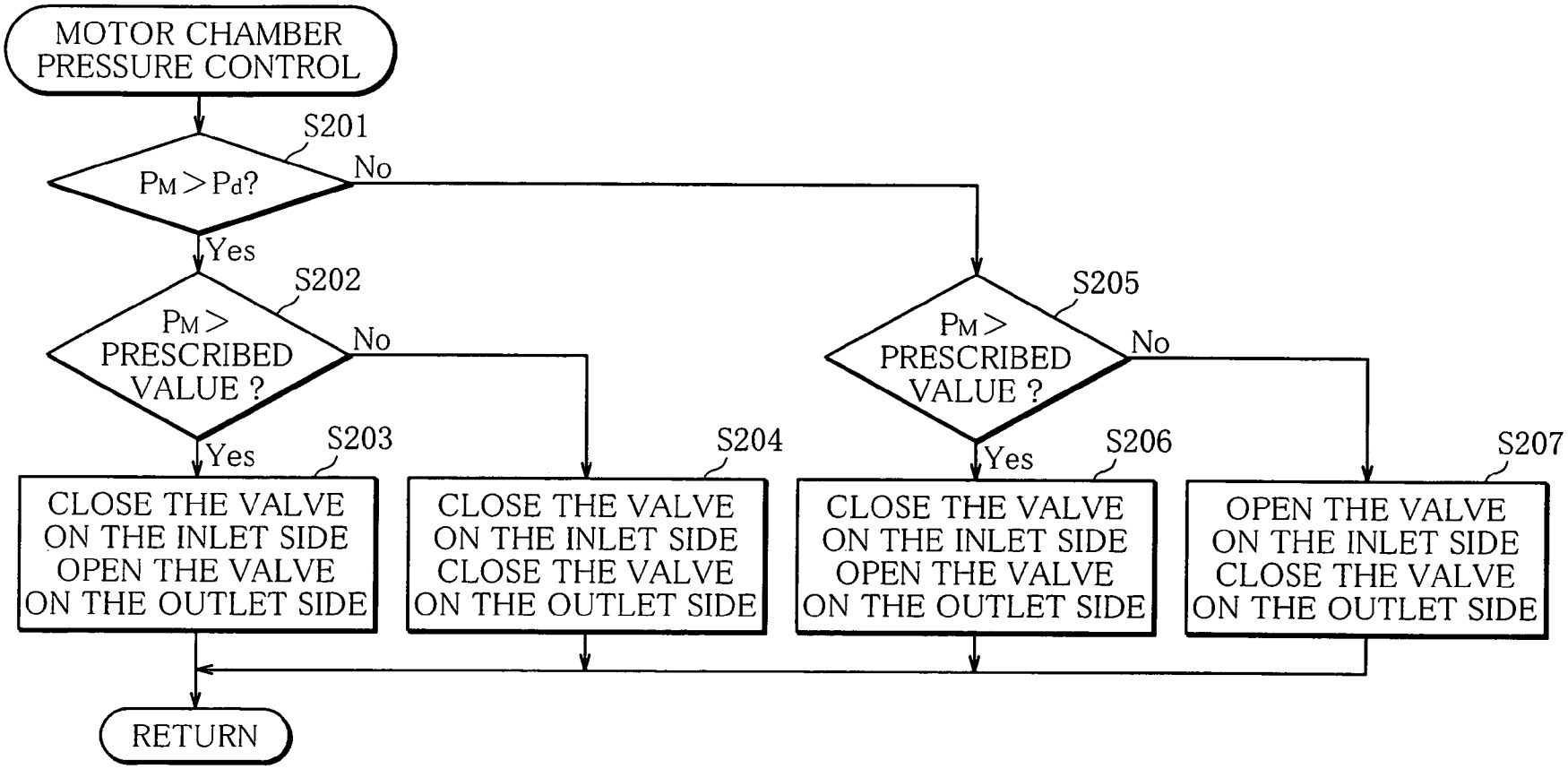
FIG. 4 is a flowchart of pressure control in a motor chamber in the compressor shown in FIG. 3.

Concretely, as shown in FIG. 4, when the pressure $P_M$ of the refrigerant in the motor chamber 26 is first read, Step S201 makes a determination as to whether the pressure $P_M$ requires immediate pressurization on the basis of pressure $P_d$ of the discharge refrigerant, which acts on the front side of the movable scroll 54. If the pressure $P_M$ is higher than the discharge pressure $P_d$, that is, if the determination is YES, the routine proceeds to Step S202.

Step S202 makes a determination as to whether the pressure $P_M$ is stable while sufficiently resisting the discharge pressure $P_d$ as load acting on the rear side of the scroll 54. More specifically, a determination is made as to whether the pressure $P_M$ exceeds a prescribed value that is a target value of the pressure in the motor chamber 26. If the pressure $P_M$ is higher than the prescribed value, or if the determination is YES, the routine advances to Step S203. At Step S203, the control valve 88 is closed and keeps the refrigerant discharged from the gas cooler 6 is kept from entering the motor chamber 26. In this case, the refrigerant is introduced from the gas cooler 6 into the internal heat exchanger 10 through the circulation path 9. At the same time, Step S203 opens the control valve 90, and depressurizes the motor chamber 26 to achieve the prescribed pressure by making the refrigerant flow out of the motor chamber 26. Then, the routine is repeated.

If Step S202 determines that the pressure $P_M$ does not exceed the prescribed value, the routine proceeds to Step S204. At Step S203, the control valves 88 and 90 are closed. In this case, immediate pressurization is not required, and a temperature rise of an electric motor 40 is used. The motor chamber 26 is pressurized so that the pressure $P_M$ reaches the prescribed value, and then the routine is repeated.

If Step S201 determines that the pressure $P_M$ is lower than the discharge pressure $P_d$, it is estimated that the pressure $P_M$ requires immediate pressurization, so that the routine proceeds to Step S205.

Step S205 makes a determination as to whether the pressure $P_M$ is stable while sufficiently resisting the discharge pressure $P_d$ as load acting on the rear side of the scroll 54. To be concrete, a determination is made as to whether the pressure $P_M$ is higher than the prescribed value that is a target value of the pressure in the motor chamber 26. If the pressure $P_M$ is higher than the prescribed value, that is, if the determination is YES, it is regarded that immediate pressurization is not required, and the routine advances to Step S206. At Step S206, the control valve 88 is closed, and simultaneously the control valve 90 is opened, thereby making the refrigerant flow out of the motor chamber 26 so as to depressurize the motor chamber 26 to achieve the prescribed value. The routine is then repeated.

To the contrary, if Step S205 determines that the pressure $P_M$ does not exceed the prescribed value, it is regarded that immediate pressurization is required. The routine then proceeds to Step S207. At Step S207, the control valve 88 is opened and the refrigerant from the gas cooler 6 is introduced into the motor chamber 26. At Step S207, the control valve 90 is simultaneously closed to prevent the refrigerant from flowing out of the motor chamber 26. As a result, the pressure in the motor chamber 26 is instantly pressurized to achieve the prescribed value. Then, the routine is repeated.

The opening/closing control of the valves 88 and 90 may be operated manually or by signals from a controller. The control valves 88 and 90 may be interlocked with each other by the signals from the controller.

As described above, according to the compressor 4 of the second embodiment, the inlet control valve 88 controls the pressure on the rear side of the movable scroll 54 in addition to the first embodiment, thereby balancing the pressure on the rear side of the movable scroll 54 with the pressure on the front side thereof. Therefore, the thrust load with respect to the movable scroll 54 is more reliably offset, which makes it possible to obtain a stable compression process in the scroll unit 52. Consequently, abrasion of spiral laps 61 and 79 is further decreased, and the scroll unit 52 is upgraded in reliability.

The outlet control valve 90 maintains the pressure in the motor chamber 26, into which the refrigerant is introduced so that its pressure acts on the rear side of the movable scroll 54, at the prescribed pressure. Therefore, the load on the rear side is further stabilized.

Furthermore, the circulation path 7 between the gas cooler 6 and the inlet hole 27, and the control valve 88 is inserted in the circulation path 7 may be applicable to a conventional compressor. Likewise, the control valve 90 inserted in the circulation path 8 between the outlet hole 28 and the evaporator 14 may be applicable to the conventional compressor. In this case, the same advantage is provided. In the case that the control valve 88 is disposed in the inlet hole 27, the compressor 4 is exchanged for a compressor installed the control valve 88 with respect to a conventional circulation path. The same can be said of the case where the control valve 90 is disposed in the outlet hole 28.

Since the refrigerant in the motor chamber 26 is delivered to the evaporator 14, the pressure control range of the outlet control valve 90 is wider than that of the outlet control valve 90 which delivers the refrigerant in the motor chamber 26 to the internal heat exchanger 10, for example, and increases advantages in respect of control.

The description about the embodiments of the present invention is finished, but the present invention is not limited to the above-described embodiments.

Figure 5:
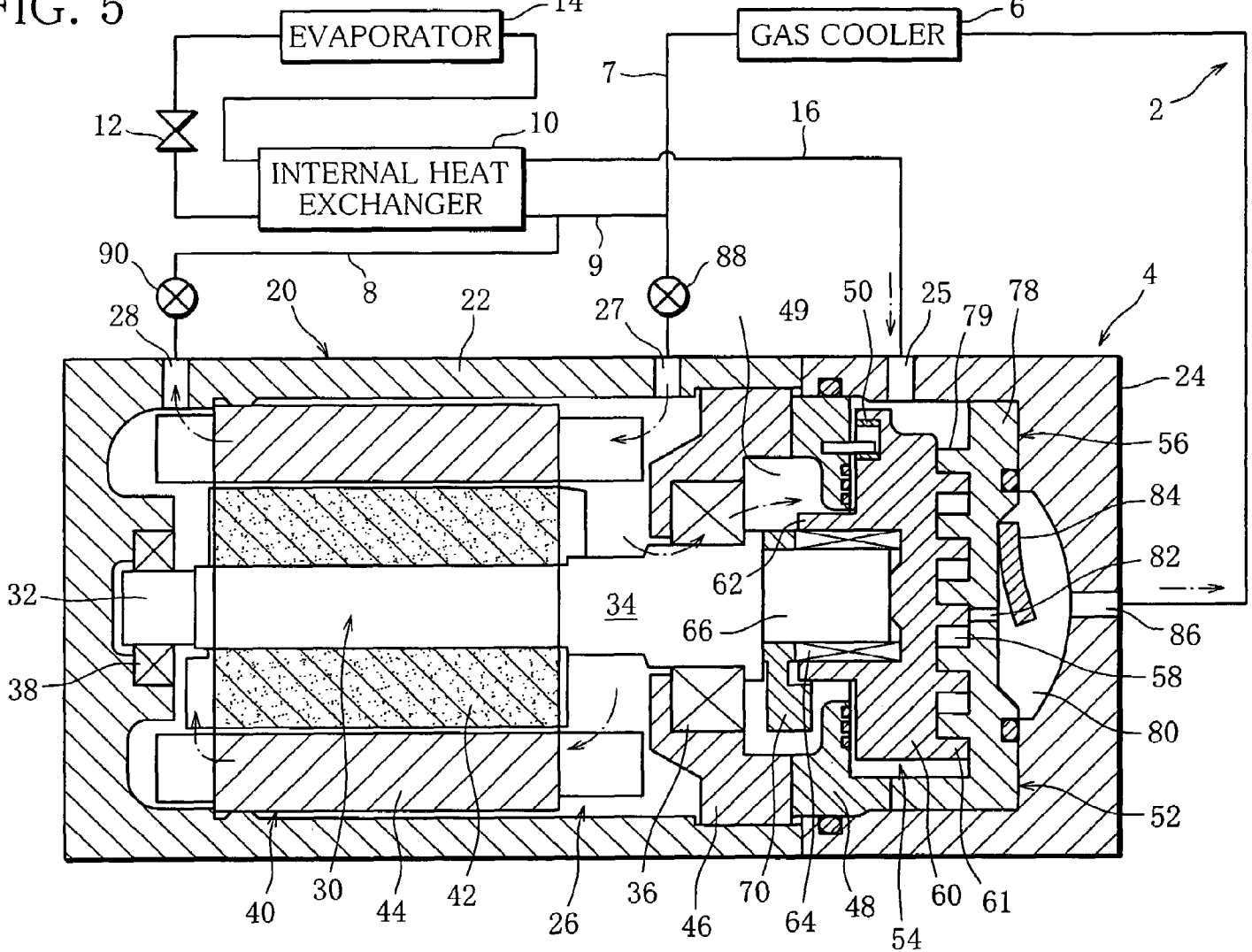
FIG. 5 is a longitudinal sectional view showing a scroll-type compressor according to a third embodiment.

For instance, in the second embodiment, the refrigerant in the motor chamber 26 is introduced through the circulation path 8 to the low pressure-side circuit between the expansion valve 12 and the evaporator 14. However, the invention is not necessarily limited to the circulation path 8 of the second embodiment. As shown in FIG. 5, the circulation path 8 may be connected to the circulation path 9 extending to the internal heat exchanger 10. In the case of this third embodiment, the refrigerant in the motor chamber 26 is usable for heat exchange in the internal heat exchanger 10, thereby contributing to the improvement of refrigeration performance. In this case, too, control valves 88 and 90 may be inserted in the circulation paths 7 and 8 or disposed in the inlet hole 27 and the outlet hole 28, respectively.

The scroll-type fluid machine of the invention can be used not only as the compressor 4 but as an expansion device. In this case, too, the scroll unit has both simplicity and rigidity, and provides the advantage that the thrust load is surely reduced.

Although in each of the above embodiments, the electric motor 40 serves as a drive source of the movable scroll 54, a vehicle engine may be use as the drive source. When a $CO_2$ refrigerant having high working pressure is used as in the embodiments, remarkable advantages can be provided. As refrigerant, however, a CFC substitute may be used. In this case, the refrigerant from a condenser is introduced through the circulation path 7 into the motor chamber 26.

The invention claimed is:

1. A scroll-type fluid machine comprising:

a housing including a drive casing and a compression casing air-tightly connected to said drive casing;

a rotary shaft rotatably supported in said drive casing through a bearing;

a scroll unit accommodated in said compression casing, said scroll unit having a movable scroll for carrying out a series of processes including suction, compression, and discharge of a refrigerant in cooperation with a fixed scroll by being driven by said rotary shaft to make a revolution of said movable scroll;

a discharge chamber defined in said compression casing, for causing the refrigerant adjusted to prescribed discharge pressure by a discharge valve to feed from said scroll unit to a refrigerant circuit;

a circulation path for introducing the refrigerant in said discharge chamber from the refrigerant circuit into said drive casing while maintaining the refrigerant pressure; and an inlet path formed in said compression casing, for leading the refrigerant in said circulation path to a rear side of said movable scroll to make a pressure of the led refrigerant counteract the refrigerant discharge pressure acting on a front side of said movable scroll.

2. The scroll-type fluid machine according to claim 1, including:

a machine chamber defined in said drive casing, said machine chamber having a motor for driving said rotary shaft when said motor is supplied with electricity; and pressure control means for controlling the pressure of the refrigerant introduced from said circulation path toward the machine chamber and received on the rear side of said movable scroll in order to adjust balance with the refrigerant discharge pressure acting on the front side of the movable scroll.

3. The scroll-type fluid machine according to claim 2, wherein:

said drive casing has a refrigerant inlet hole through which the refrigerant in said circulation path is introduced toward said machine chamber; and the pressure control means is arranged either in said circulation path or in said refrigerant inlet hole.

4. The scroll-type fluid machine according to claim 3, wherein:

said refrigerant inlet hole receives the refrigerant from a gas cooler in said refrigerant circuit to be introduced into said machine chamber.

5. The scroll-type fluid machine according to claim 2, including:

a second circulation path for leading out the refrigerant in said machine chamber from said machine chamber toward said refrigeration circuit, wherein:

the refrigerant in said machine chamber is led through the second circulation path to a low pressure-side circuit of said refrigeration circuit and is subsequently introduced to said scroll unit through a suction port formed in said compression casing.

6. The scroll-type fluid machine according to claim 5, further including:

a second pressure control means for controlling the pressure of the refrigerant led out of said machine chamber toward said second circulation path in order to maintain the refrigerant pressure in said machine chamber at the prescribed pressure.

7. The scroll-type fluid machine according to claim 6, wherein:

said drive casing has a refrigerant outlet hole through which the refrigerant in said machine chamber is led out and directed toward said second circulation path; and said second pressure control means is arranged either in said refrigerant outlet hole or in said second circulation path.

8. The scroll-type fluid machine according to claim 7, wherein:

the refrigerant in said machine chamber is led out through said refrigerant outlet hole and directed toward an internal heat exchanger inserted in said refrigeration circuit.

9. The scroll-type fluid machine according to claim 7, wherein:

the refrigerant in said machine chamber is led out through the refrigerant outlet hole and directed toward an evaporator inserted in said refrigeration circuit.

10. The scroll-type fluid machine according to claim 1, wherein:

the refrigerant contains lubricating oil; and the lubricating oil separated from the refrigerant in said discharge chamber is introduced to the bearing through a communication path formed in said compression casing.

11. The scroll-type fluid machine according to claim 1, wherein:

the refrigerant is a $CO_2$ refrigerant.

* * * * *